US005205869A

United States Patent [19]

Ahern

[11] Patent Number: 5,205,869

[45] Date of Patent: Apr. 27, 1993

[54] OVERSPRAY EXTRACTOR

[75] Inventor: Michael D. Ahern, Fond du Lac, Wis.

[73] Assignee: Harbridge, Inc., Fond du Lac, Wis.

[21] Appl. No.: 734,150

[22] Filed: Jul. 22, 1991

[51] Int. Cl.[5] ..... B05B 13/02

[52] U.S. Cl. ..... 118/324; 118/DIG. 7; 118/326

[58] Field of Search ..... 126/299 R; 454/49, 50, 454/56; 118/309, 326, DIG. 7, 324

[56] References Cited

U.S. PATENT DOCUMENTS 4,489,316 11/1984 Fritz et al. ..... 126/299 R
4,730,647 3/1988 Mulder ..... 118/326
5,020,511 6/1991 Liu ..... 126/299 R

*Primary Examiner*—W. Gary Jones
*Assistant Examiner*—Charles K. Friedman
*Attorney, Agent, or Firm*—Donald Cayen

[57] ABSTRACT

An overspray extractor collects the overspray of a volatile organic compound coating material sprayed onto three-piece steel cans. The overspray extractor comprises a hood having five orthogonal walls, with the bottom wall having a slot of predetermined width that is placed above the cans and downstream of the coating material nozzles. The ratio of the height of the hood between the top and bottom walls to the width of the bottom wall slot is greater than one. The hood is connected by means of a throat located opposite an outside wall to an exhaust passage. When a vacuum is applied to the hood, coating material overspray and atmospheric air are drawn into the hood through the slot and through the hood into the exhaust passage. A slit in the outside wall permits atmospheric air to be drawn into the hood to flow along and scrub the top wall of solids from the coating material that coagulate on the top wall. The overspray extractor further comprises a face plate that removably covers an opening in the outside wall. Removing the cover enables the interior of the hood to be cleaned in place. The overspray extractor operates for much longer times without requiring cleaning and requires less power than prior equipment.

23 Claims, 2 Drawing Sheets

OVERSPRAY EXTRACTOR

BACKGROUND OF THE INVENTION

1. Field of the Invention

This invention pertains to environmental protection, and more particularly to apparatus for collecting and disposing of industrial coatings.

2. Description of the Prior Art

Millions of three-piece steel cans are manufactured daily. The process of manufacturing the bodies of the steel cans involves many carefully controlled steps. Generally, a flat sheet of steel is coated on both sides with a thin layer of an organic compound that protects the can from the product the can is to hold. Narrow margins on both faces along two opposed edges of the sheet are left uncoated. The sheet is rolled such that the uncoated edges abut to form a thin walled tube with a longitudinal axis. The tubes are propelled sequentially along their longitudinal axes in a downstream direction past a welding station. At the welding station, in-line continuous welding systems operate to weld together the abutting edges to form a stable thin walled tube that serves as the can body.

From the welding station, the can bodies continue downstream to a liquid stripe application or coating station. At the coating station, stationary nozzles spray the continuously moving can bodies along their welded seams with the proper organic compound such that the entire inner and/or outer surfaces of the can bodies are properly coated. The coating materials typically are volatile organic compounds such as lacquers, enamels, and vinyls, and they are composed of known solids and solvents. From the coating station, the cans move downstream for further processing.

Coating the welded seams of the can bodies presents several difficult problems. The coating material must be accurately directed so as to strike and coat the welded seams while at the same time coating as little of the adjacent can areas as possible. To avoid spraying excessive material, the coating equipment must operate in a carefully controlled manner so that the coating material is sprayed only when a can is present at the coating station during its continuous downstream motion. Two paramount requirements are to minimize overspray of the coating material and to prevent any overspray from continuing downstream or from entering the atmosphere.

To collect coating material overspray and prevent it from entering the atmosphere, it is known to provide the liquid stripe application or coating stations of seamed can bodymakers with vacuum operated exhaust systems. The exhaust systems collect the overspray and direct it to a filter that traps the coating material solids for subsequent disposal. The solvents of the coating material overspray pass through the filter to be burned or otherwise properly disposed of.

FIGS. 1 and 2 show simplified side and front views, respectfully, of a prior exhaust system 1 for a seamed can bodymaker. The can bodies 3 travel continuously at high speeds in the downstream direction of arrow 5. Stationary nozzles schematically represented by reference numeral 7 spray coating material on the external and internal surfaces of the can bodies 3 along the welded seams 8 thereof as the can bodies travel past the nozzles.

The prior exhaust system 1 includes a hood 9 with an open slot 11 that is a short distance above the spray nozzles 7. The hood 9 has an arcuate bend of approximately 90 degrees. Depending upon the specific application, the length of the slot 11 may range between approximately nine and 18 inches and have approximately a two inch width. The hood connects via a throat 13 with an exhaust passage 15. The areas of the hood inlet slot 11 and outlet throat 13 are generally equal. The exhaust passage 15 opens into a filter box 17.

To draw overspray from the nozzles 7 into the exhaust system 1, a vacuum is created in the filter box 17, exhaust passage 15, and hood 9 by a blower, not shown, that is connected to a filter box stack 19. The overspray thus flows through the hood to the filter box, where the solids in the coating material overspray are separated. The remaining solvents are drawn out through the stack 19 for appropriate processing.

During normal operation, some overspray from the coating material coagulates into a gel like substance 20 on the hood concave inner surface 18. The coagulant 20 tends to drip back through the hood slot 11 and onto the can bodies 3. Further, as the solids coagulate on the hood surface 18, the area in the hood 9 through which the overspray material must flow decreases. Consequently, the pressure drop required to maintain adequate overspray flow through the hood and the rest of the exhaust system 1 increases, thereby resulting in increased power consumption by the blower. To maintain proper operation, the substance 20 must be removed from the surface 18 at regular intervals. For example, with some spray materials, the coagulant must be cleaned from the hood surface 18 after approximately eight hours of system operation.

The prior exhaust system 1 functions adequately, and numerous installations have been in successful operation for many years. Despite the fact that the hood 9 must be removed from the rest of the exhaust system for cleaning the overspray solids 20, the frequency of cleaning is tolerable. However, increasingly stringent environmental considerations have made the problems associated with coating material overspray collection much more difficult to solve. Particularly, whereas formerly high solvent coating materials were acceptable, recent regulations dictate that high solid content coating materials now be used. Unfortunately, the prior exhaust system 1 does not work as well with high solid coating materials as with high solvent materials. High solid coating materials tend to coagulate at much faster rates on the hood surface 18 than high solvent materials. As a result, more frequent cleaning of the hood surface 18 is necessary. In some installations, the surface 18 must be cleaned approximately two times oftener with the new high solid coating materials than with previous coating materials. That increase in the frequency of cleaning is unacceptable.

Thus, a need exists for an overspray exhaust system that is capable of handling high solid content coating materials.

SUMMARY OF THE INVENTION

In accordance with the present invention, an overspray extractor is provided that more efficiently controls overspray of volatile organic compounds than was previously possible. This is accomplished by apparatus that includes a spray collecting hood having a bottom wall with an inlet slot and a top wall located parallel to and above the bottom wall at a distance therefrom that is greater than the width of the bottom wall slot.

In addition to the bottom and top walls, the hood is comprised of two end walls and an outside wall so as to form a five sided orthogonal enclosure. The bottom wall is generally horizontal, and it defines a generally rectangular slot that extends between the two end walls. The outside wall extends between the two end walls and between the top wall and the bottom wall. The side of the hood opposite the outside wall is open.

The open side of the hood forms a throat that opens into a vertically oriented exhaust passage. The exhaust passage extends upwardly and downwardly from the hood throat. The lower end of the exhaust passage is closed. The upper end of the exhaust passage opens into the inlet end of a filter box. A blower is installed at the outlet end of the filter box.

Typical dimensions of the hood components include top and bottom walls that range between approximately nine and 18 inches long between the end walls and approximately 10.5 inches between the hood throat and the outside wall. The outside and end walls are approximately seven inches high. The slot in the bottom wall is approximately two inches wide and is preferably located closer to the outside wall than to the throat. The ratio of the height of the end and outside walls to the width of the bottom wall slot is called the hood aspect ratio; in the example given, the aspect ratio is 3.5.

By operating the blower, overspray and atmospheric air are drawn at a relatively high inlet velocity through the bottom wall slot into the hood. From the hood, the mixed overspray and air are drawn through the throat into the vertical exhaust passage, and then through the filter box.

Inside the hood, the velocity of the overspray and atmospheric air decreases considerably from their inlet velocity. The mixed overspray and air also leave the hood through the throat at a velocity lower than the inlet velocity. The ratio of inlet and outlet velocities is inversely proportional to the hood aspect ratio.

The unexpected advantage of the overspray extractor employing the hood of the present invention is that the solids of sprayed high solid content volatile organic compounds do not readily coagulate inside the hood. While some coagulation does occur on the hood top wall, the buildup is much less than in prior overspray collection equipment and is well within commercially acceptable limits.

Further in accordance with the present invention, the hood is cleanable in place on the exhaust passage. For that purpose, the entire outside wall is not permanently joined to the end, bottom, and top walls. Rather, a portion of the outside wall is composed of a generally U-shaped face plate having opposed legs that overlie respective end walls. A wing nut and slot arrangement is employed to removably attach the face plate legs to the end walls. As a result, the face plate can be easily removed for providing access to the interior of the hood to clean most accumulated overspray solids.

To further reduce coagulation of the overspray materials on the interior of the hood, the overspray extractor of the present invention also includes an auxiliary wiper. In the preferred embodiment, the auxiliary wiper is formed as a slit in the outside wall a short distance from its junction with the top wall. The slit extends between the two end walls. The slit is formed by the cooperation of the top wall and the free edge of an angled plate connected to the outside wall. The free end of the angled plate is spaced inwardly from the plane of the outside wall. Consequently, air can enter the hood through the slit between the plate free edge and the top wall. That construction directs air drawn by the blower to flow along the top wall to the hood throat. The flowing air creates a scrubbing action on the top wall that reduces the tendency of the solids in the volatile organic compounds to coagulate on the top wall, thereby contributing to the effectiveness of the overspray extractor.

Other advantages, benefits, and features of the present invention will be apparent to those skilled in the art upon reading the detailed description of the invention.

DETAILED DESCRIPTION OF THE INVENTION

Although the disclosure hereof is detailed and exact to enable those skilled in the art to practice the invention, the physical embodiments herein disclosed merely exemplify the invention, which may be embodied in other specific structure. The scope of the invention is defined in the claims appended hereto.

Figure 3:
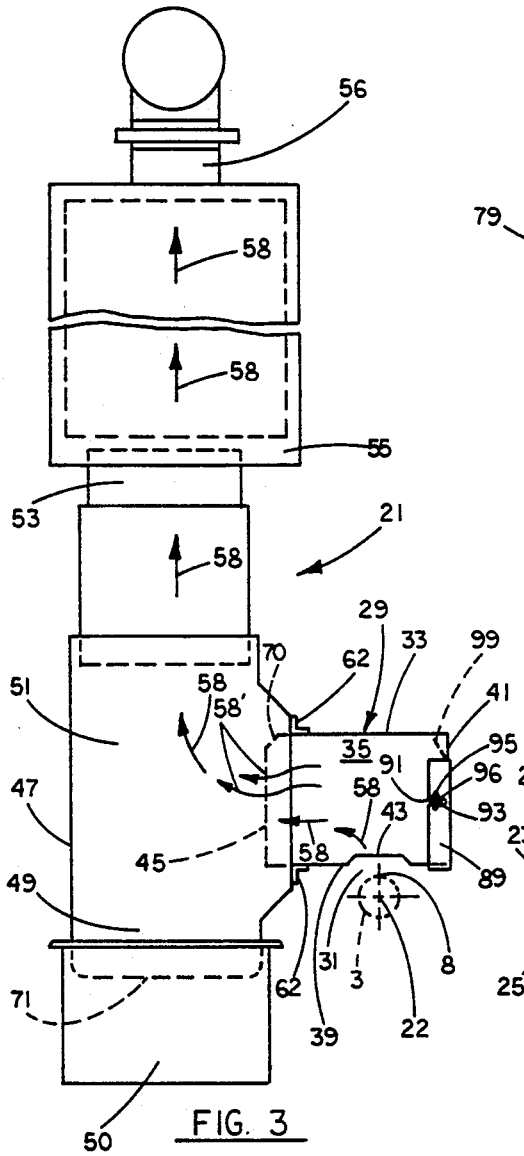
FIG. 3 is a side view of the overspray extractor of the present invention.
Figure 4:
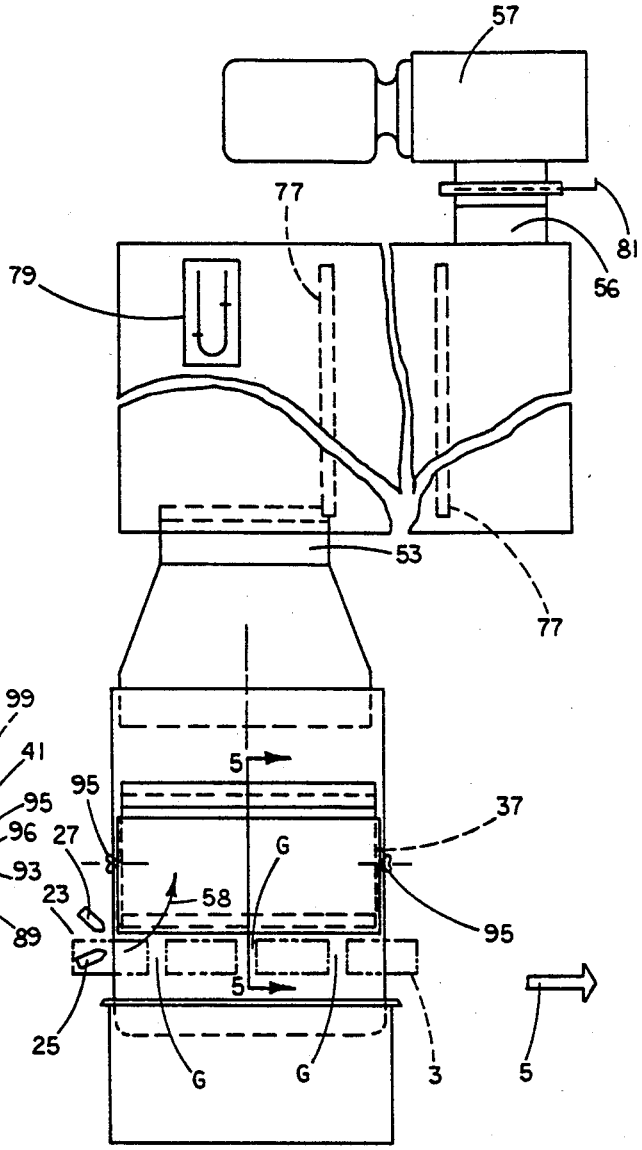
FIG. 4 is a front view of FIG. 3.

Referring to FIGS. 3 and 4, an overspray extractor 21 is illustrated that includes the present invention. The overspray extractor 21 is particularly useful for collecting and controlling liquid coating materials sprayed on the bodies 3 of three-piece steel cans, but it will be understood that the invention is not limited to can body-making applications.

GENERAL

For purposes of background, the manufacture of three-piece steel cans involves the propulsion of the can bodies 3 on a continuous basis, with their longitudinal axes 22 horizontal, in the downstream direction of arrow 5 by known can transporting equipment, not shown. The can bodies are welded along respective longitudinal seams 8 at a welding station, not illustrated in FIGS. 3 and 4. Subsequent to being welded, the cans enter a coating station 23. At the coating station 23, the interiors and/or exteriors of the welded seams 8 are sprayed with a coating material from inner and/or outer nozzles 25 and 27, respectively. The coating material is normally a volatile organic compound, such as a lacquer, vinyl, or enamel. Volatile organic compounds used in modern seamed can bodymakers have a relatively high proportion of solid materials dissolved in a relatively low proportion of solvents.

An inherent characteristic of the can seam coating process is that more coating material is sprayed from the nozzles 25 and 27 then is actually deposited on the cans 3. Consequently, the overspray must be collected and properly disposed of. For that purpose, a hood 29 of the overspray extractor 21 of the present invention is located immediately downstream of the coating station 23, and the hood overlies the can bodies 3 as they continuously move downstream from the coating station.

The nozzles 25 and 27 are positioned such that the coating materials sprayed from them are directed toward the underside 31 of the hood 29.

The hood 29 defines a velocity reduction chamber 60 that has an entrance slot 43 and an exit throat 45. The velocity reduction chamber 60 opens through the throat 45 into a vertically oriented exhaust passage 47. A lower portion 49 of the exhaust passage 47 below the velocity reduction chamber throat 45 connects with a removable pan 50. The upper end 51 of the exhaust passage 47 is connected to the inlet end 53 of a filter box 55. The filter box 55 has an outlet end 56 to which is mounted a blower 57. By operating the blower 57, overspray from the nozzles 25 and 27 is drawn in the direction of arrows 58 through the slot 43 into the velocity reduction chamber 60 and from the velocity reduction chamber through the exhaust passage 47 and filter box 55.

HOOD

Figure 1:
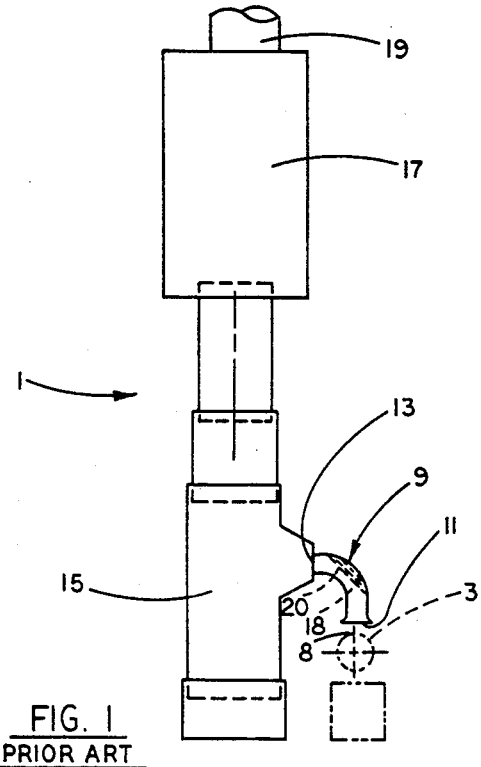
FIG. 1 PRIOR ART
FIG. 1 is a simplified side view of a portion of a prior art exhaust system for collecting sprayed coating materials.
Figure 2:
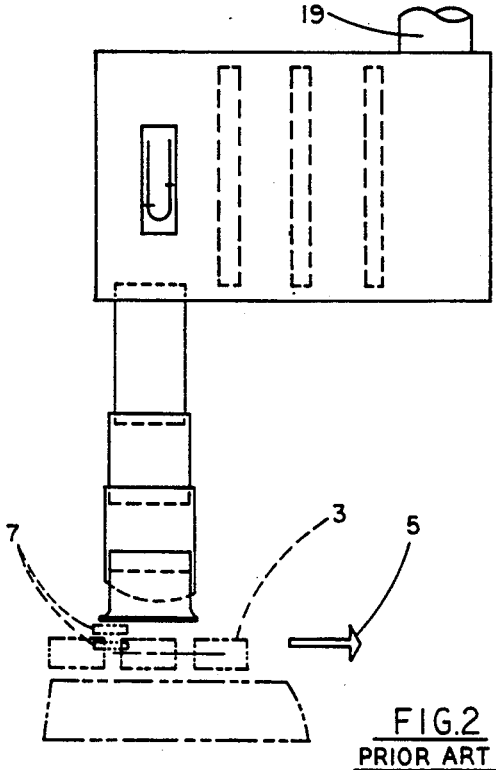
FIG.2 PRIOR ART
FIG. 2 is a front view of FIG. 1.
Figure 5:
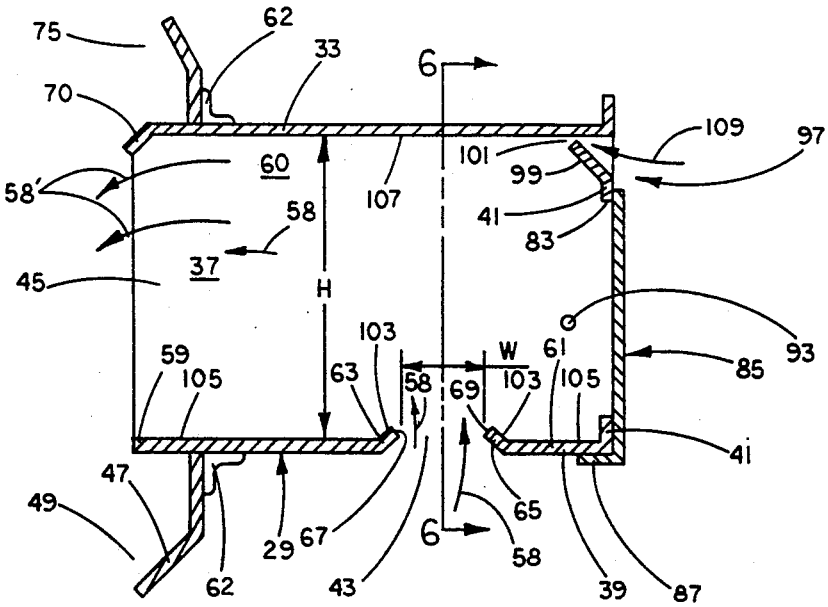
FIG. 5 is a cross sectional view on an enlarged scale taken along lines 5—5 of FIG. 4.
Figure 6:
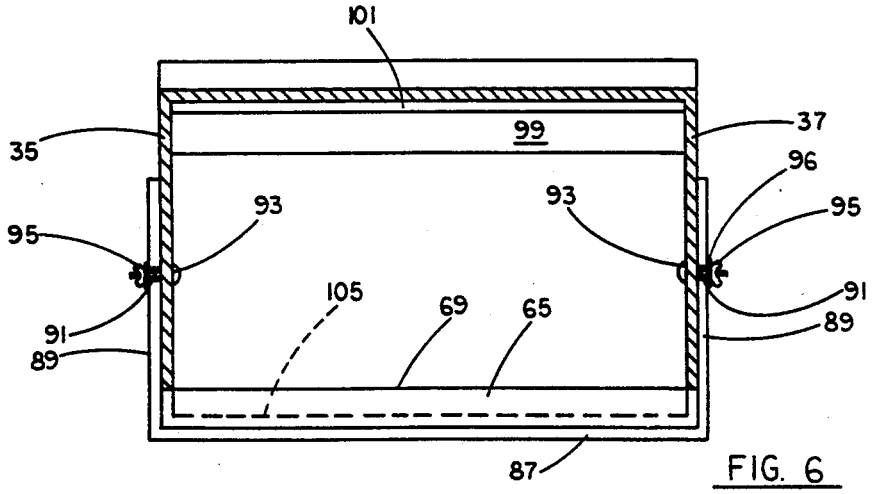
FIG. 6 is a cross sectional view taken along lines 6—6 of FIG. 5.

Looking also at FIGS. 5 and 6, the hood 29 is comprised of a top wall 33, an upstream end wall 35, a downstream end wall 37, a bottom wall 39, and an outside wall 41. The hood may be attached to the exhaust passage 47 by conventional angles 62. The walls 33, 35, 37, 39, and 41 define the velocity reduction chamber 60 of the hood. The bottom wall 39 is fabricated with two spaced apart coplanar panels 59 and 61. The panels 59 and 61 extend for the full length of the hood between the end walls 35 and 37. Connected to the facing edges of the panels 59 and 61 are respective angled strips 63 and 65. The angled strips 63 and 65 converge upwardly toward the top wall 33, making obtuse angles of approximately 150 degress with the panels 59 and 63, respectively. The free edges 67 and 69 of the angled strips 63 and 65, respectively, define the width of the hood slot 43 and are spaced apart a distance W. The spacing between the end walls, and thus the length of the slot, preferably ranges from between approximately nine and 18 inches, depending on the application at hand.

It is a feature of the present invention that the height H between the hood bottom wall 39 and top wall 33, and thus the height of the end walls 35 and 37, is considerably greater than the width W of the slot 43. It is useful to define the ratio of the height H of the hood to the width W of the slot as the aspect ratio of the hood 29. Consequently, the aspect ratio of the hood is greater than 1, and the aspect ratio is preferably in the neighborhood of 3.5. Specifically, it has been found that a width W of approximately two inches and a height H of approximately seven inches works very well for many applications. With those two dimensions, the ideal length of the hood between the throat 45 and the outside wall 41 is approximately 10.5 inches, but that dimension may vary depending on the clearance available from nearby machinery.

As mentioned, the hood velocity reduction chamber 60 opens into the exhaust passage 47 through the hood throat 45. To enhance collection of volatile organic compound solids precipitated from the solvents within the velocity reduction chamber and within the exhaust passage, the flowing overspray and atmospheric air are deflected slightly downwardly as they leave the velocity reduction chamber through the hood throat 45, as is indicated by arrows 58' in FIGS. 3 and 5. The deflection is created by a short tab 70 bent in the hood top wall 33 at the throat and extending between the two end walls 35 and 37. A tab approximately one inch long and at 45 degrees to the plane of the top wall works very well.

EXHAUST PASSAGE AND FILTER BOX

The exhaust passage 47 has a trap portion 49 that extends several inches below the hood throat 45. The exhaust passage is open at its bottom end 71, and the open bottom is covered with a removable pan 50. The lower end 71 of the exhaust passage and the pan 50 serve as a liquid trap for any precipitated coating material solids leaving the hood 29.

The upper end 51 of the exhaust passage 47 connects with the inlet end 53 of the filter box 55. A number of mechanical filters 77, as are known in the art, are installed in the filter box. There is also a conventional liquid manometer 79 on the filter box, and a damper 81 between the outlet end 56 of the filter box and the blower 57.

CLEAN IN PLACE

Further in accordance with the present invention, the velocity reduction chamber 60 is easily and quickly accessible. That result is achieved by providing an opening 83 in the outside wall 41 and by covering the opening 83 with a tight fitting but removable face plate 85. Preferably, the face plate 85 has a bottom angle 87 that wraps around the bottom wall 39 of the hood 29 and end angles 89 that wrap around the associated hood end walls 35 and 37. For convenient removal and replacement, the face plate end angles 89 are cut out with slots 91. Studs or thumb screws 93 project through the hood and the face plate slots 91 and cooperate with wing nuts 95 and washers 96 to removably hold the face plate to the hood 29.

AUXILIARY WIPER

In the preferred embodiment, the overspray extractor 21 is designed with an auxiliary wiper 97. Looking especially at FIG. 5, it will be noticed that the outside wall 41 of the hood 29 is formed with an inwardly extending angular plate 99 near the top wall 33. The outside wall angular plate 99 does not join with the top wall. Instead, a narrow slit 101 is formed between the free edge of the angular plate and the hood top wall. The slit 101 runs for the full length of the hood between the end walls 35 and 37.

OPERATION

In operation, overspray of coating material from the inside nozzle 25 escapes through gaps G between successive cans 3 as the cans pass longitudinally in the downstream direction 5 under the overspray extractor hood 29. The blower 57 is energized to draw atmospheric air and overspray from both nozzles 25 and 27 through the hood slot 43 into the velocity reduction chamber 60 along a flow path generally indicated by arrows 58. The damper 81 is positioned within the filter box outlet 56 in light of information provided by the manometer 79 to calibrate the overspray extractor 21 for optimum performance.

As the overspray and air flow through the slot 43 into the velocity reduction chamber 60, their velocity is decreased considerably. In the velocity reduction chamber, a small amount of the solids of the coating material overspray precipitates from the solvents. Some of those solids collect on the inside surfaces 103 of the hood angled plates 63 and 65 and drain to the flat inside surfaces 105 of the bottom wall sections 59 and 61.

Accordingly, the hood region adjacent the angled surfaces 103 act as a liquid trap.

As the overspray and air are drawn along in the direction of arrows 58 through the hood throat 45 into the exhaust passage 47, they are deflected slightly downwardly as indicated by the arrows 58' of FIG. 5 by the angled tab 70. Additional amounts of overspray solids precipitate out of the coating material as the overspray and air flow through the throat 45. The downward deflection of the overspray and air caused by the tab 70 results in those solids falling by gravity to the bottom pan 50, where they are collected for easy and proper disposal. The great majority of the solids remain dissolved in the solvent of the coating material as it passes up the exhaust passage to the filter box 55. There, the filters 77 mechanically remove the remainder of the volatile organic compound solids in dry form, enabling those solids to be easily and properly handled. The overspray solvent passes directly to the atmosphere or to an incinerator for burning, as is known in the art.

The outstanding benefit of the overspray extractor 21 is that the solids in the can coating material have much less propensity to coagulate inside the hood 29. In addition, the overspray extractor 21 requires less power to operate compared to prior exhaust systems. Specifically, the collection of solids of high solid content coating material on the inside surface 107 of the top wall 33 is far less than on analogous surfaces of prior equipment. The slit 101 contributes to keeping the hood surface 107 clean over the slot 43. That is because during operation a stream of air is drawn into the velocity reduction chamber 60 through the slit by the blower 57, as is indicated by arrow 109. The air stream 109 passes along the top wall surface 107 on its way to the hood throat 45. The air stream acts to scrub any coagulated coating material solids from the surface 107. Some of those solids may be redissolved in the solvent of the main overspray flow of arrows 58. Other of those solids fall to the liquid trap in the pan 50 or onto the hood bottom wall inside surface 105.

Other reasons for the greatly reduced tendency of the solids in the coating material to coagulate on the top wall inside surface 107 are not fully understood. A factor for reduced solid coagulation has to do with the reduction in velocity of the overspray and air as they pass into the velocity reduction chamber 60 through the slot 43. In any event, downtime for cleaning the inside of the hood 29 is greatly reduced. When cleaning coagulated overspray solids is eventually required, it is a simple matter to remove the face plate 85 by means of the wing nuts 95 and thus quickly and easily clean in place the velocity reduction chamber 60.

The reduction in power requirements of the overspray extractor 21 is another benefit of the reduction of overspray solid coagulation on the hood top wall surface 107. The reduction in power is related to the reduction in velocity within the velocity reduction chamber 60 and to the increased amount of air drawn through the hood 29. The reduction in overspray coagulation and the reduction in power requirements combine to render the overspray extractor 21 a significant advance in the art of collecting coating material overspray in seamed can bodymakers.

Thus, it is apparent that there has been provided, in accordance with the invention, an overspray extractor that fully satisfies the aims and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

I claim:

1. An exhaust system for handling selected fluids comprising:

a. pump means for creating a vacuum;

b. filter means having an outlet end connected to the pump means and an inlet end;

c. an exhaust passage having an outlet end connected to the inlet end of the filter means and an inlet end; and d. a hood comprising:

i. opposed end walls of predetermined height;

ii. a top wall extending between and generally perpendicular to the end walls;

iii. an outside wall extending between and generally perpendicular to the end walls; and iv. a bottom wall opposite the top wall and defining a slot of predetermined width therein that extends between the two end walls, the end, top, outside, and bottom walls cooperating to define a chamber having an open throat opposite the outside wall that connects with the inlet end of the exhaust passage, the ratio of the height of the end walls to the width of the bottom wall slot being greater than one, so that operation of the pump means draws the selected fluids through the hood bottom wall slot into the chamber and through the hood throat from the chamber to the exhaust passage.

2. The exhaust system of claim 1 wherein the ratio of the height of the hood end walls to the width of the hood bottom wall slot is approximately 3.5.

3. The exhaust system of claim 2 wherein the width of the bottom wall slot is approximately two inches, and wherein the distance between the hood end walls is between approximately nine and 18 inches.

4. An exhaust system for handling selected fluids comprising:

a. pump means for creating a vacuum;

b. filter means having an outlet end connected to the pump means and an inlet end;

c. an exhaust passage having an outlet end connected to the inlet end of the filter means and an inlet end; and d. a hood comprising:

i. opposed end walls of predetermined height;

ii. a top wall extending between and generally perpendicular to the end walls;

iii. an outside wall extending between and generally perpendicular to the end walls; and iv. a bottom wall opposite the top wall and defining a slot of predetermined width therein that extends between the two end walls, the end, top, outside, and bottom walls cooperating to define a chamber having an open throat opposite the outside wall that connects with the inlet end of the exhaust passage, the ratio of the height of the end walls to the width of the bottom wall slot being greater than one, wherein the hood outside wall has an opening therethrough; and the hood further comprises face plate means removably covering the opening in the outside wall for providing access to the chamber for cleaning thereof, so that operation of the pump means draws the selected fluids through the hood bottom wall slot into the chamber and through the hood throat from the chamber to the exhaust passage.

5. An exhaust system for handling selected fluids comprising:

a. pump means for creating a vacuum;

b. filter means having an outlet end connected to the pump means and an inlet end;

c. an exhaust passage having an outlet end connected to the inlet end of the filter means and an inlet end; and d. a hood comprising:

i. opposed end walls of predetermined height;

ii. a top wall extending between and generally perpendicular to the end walls;

iii. an outside wall extending between and generally perpendicular to the end walls; and iv. a bottom wall opposite the top wall and defining a slot of predetermined width therein that extends between the two end walls, the end, top, outside, and bottom walls cooperating to define a chamber having an open throat opposite the outside wall that connects with the inlet end of the exhaust passage, the ratio of the height of the end walls to the width of the bottom wall slot being greater than one, wherein the hood bottom wall comprises first and second spaced apart generally coplanar panels extending between the hood end walls; and first and second strips, each strip having a first edge joined to a respective panel and a second edge, the first and second strips converging toward the hood top wall, the second edges of the first and second strips being spaced apart to define the width of the hood slot, so that operation of the pump means draws the selected fluids through the hood bottom wall slot into the chamber and through the hood throat from the chamber to the exhaust passage.

6. An exhaust system for handling selected fluids comprising:

a. pump means for creating a vacuum;

b. filter means having an outlet end connected to the pump means and an inlet end;

c. an exhaust passage having an outlet end connected to the inlet end of the filter means and an inlet end; and d. a hood comprising:

i. opposed end walls of predetermined height;

ii. a top wall extending between and generally perpendicular to the end walls;

iii. an outside wall extending between and generally perpendicular to the end walls; and iv. a bottom wall opposite the top wall and defining a slot of predetermined width therein that extends between the two end walls, the end, top, outside, and bottom walls cooperating to define a chamber having an open throat opposite the outside wall that connects with the inlet end of the exhaust passage, the ratio of the height of the end walls to the width of the bottom wall slot being greater than one, wherein the hood top wall is formed with an angular tab at the hood throat, the tab extending between the hood end walls and extending toward the hood bottom wall, so that operation of the pump means draws the selected fluids through the hood bottom wall slot into the chamber and through the hood throat from the chamber to the exhaust passage, and the selected fluids drawn through the hood throat from the hood chamber are deflected toward the hood bottom wall.

7. An exhaust system for handling selected fluids comprising:

a. pump means for creating a vacuum;

b. filter means having an outlet end connected to the pump means and an inlet end;

c. an exhaust passage having an outlet end connected to the inlet end of the filter means and an inlet end; and d. a hood comprising:

i. opposed end walls of predetermined height;

ii. a top wall extending between and generally perpendicular to the end walls; and iii. an outside wall extending between and generally perpendicular to the end walls, wherein the hood outside wall is fabricated with a plate extending between the end walls, the plate making a predetermined angle with the outside wall and having a free edge that is spaced a short distance from the top wall; and iv. a bottom wall opposite the top wall and defining a slot of predetermined width therein that extends between the two end walls, the end, top, outside, and bottom walls cooperating to define a chamber having an open throat opposite the outside wall that connects with the inlet end of the exhaust passage, the ratio of the height of the end walls to the width of the bottom wall slot being greater than one, so that operation of the pump means draws the selected fluids through the hood bottom wall slot into the chamber and through the hood throat from the chamber to the exhaust passage, and the angle free edge and the top wall define a slit in the outside wall adjacent the top wall through which atmospheric air is drawn into the chamber by the vacuum means.

8. Apparatus for coating the seams of welded cans comprises:

a. means for propelling the cans in a downstream direction;

b. nozzle means at a coating station for spraying a volatile organic compound onto the can seams;

c. a hood downstream of the coating station, the hood comprising spaced apart upstream and downstream end walls of a predetermined height, a top wall, an outside wall, and a bottom wall that cooperate to define a velocity reduction chamber, the bottom wall defining a slot of predetermined width therethrough and extending between the upstream and downstream end walls, the bottom wall slot being located generally above the cans as they are propelled in the downstream direction, the ratio of the height of the upstream and downstream end walls to the width of the bottom wall slot being greater than one, the hood upstream and downstream end walls, bottom wall, and top wall cooperating to define a throat opposite the outside wall; and d. exhaust means connected to the hood at the throat thereof for drawing overspray of volatile organic compounds from the nozzle means and atmospheric air into the hood velocity reduction chamber through the bottom wall slot and out the velocity reduction chamber through the hood throat.

9. The apparatus of claim 8 wherein the hood bottom wall comprises:

a. a pair of spaced apart coplanar panels extending between the upstream and downstream end walls; and b. a pair of strips joined to the respective panels and making an obtuse angle therewith, the strips having respective free edges that are spaced apart to define the width of the bottom wall slot.

10. The apparatus of claim 9 wherein the angle between the bottom wall panels and the associated angled strips is approximately 150 degrees.

11. The apparatus of claim 9 wherein the distance between the free edges of the bottom wall angled strips is approximately two inches, so that the bottom wall slot has a width of approximately two inches.

12. The apparatus of claim 11 wherein the height of the end walls is approximately seven inches.

13. The apparatus of claim 8 wherein the ratio of the height of the end walls to the width of the bottom wall slot is approximately 3.5.

14. The apparatus of claim 8 wherein:

a the hood outside wall defines an opening therethrough; and b. the hood means further comprises a face plate removably fastened to selected walls thereof and covering the outside wall opening, so that the hood velocity reduction chamber can be cleaned by removing the face plate.

15. The apparatus of claim 8 wherein the hood top wall at the hood throat is formed with a tab that extends between the hood upstream and downstream end walls and that makes an obtuse angle with the top wall, the tab directing the volatile organic compound overspray and atmospheric air downwardly toward the hood bottom wall as the overspray and atmospheric air are drawn out of the velocity reduction chamber through the hood throat.

16. The apparatus of claim 8 wherein the hood outside wall is formed with a plate that makes an obtuse angle therewith and that has a free edge, the plate free edge being spaced from the hood top wall and cooperating therewith to define a slit adjacent the top wall that enables atmospheric air to be drawn into the velocity reduction chamber by the exhaust means and to be drawn along the hood top wall toward the hood throat to scrub coagulated solids of the volatile organic compound from the top wall.

17. A hood useful for collecting overspray from a sprayed coating material comprising:

a. opposed end walls of a predetermined height;

b. a top wall connected to the end walls and perpendicular thereto;

c. a bottom wall connected to the end walls and perpendicular thereto and defining a slot of a predetermined width extending between the end walls, the end, bottom, and top walls defining a throat; and d. an outside wall connected to the top, end, and bottom walls and perpendicular thereto and opposite the throat, the end, top, bottom, and outside walls cooperating to define a chamber, so that overspray can enter the chamber through the slot in the bottom wall and leave through the throat.

18. The hood of claim 17 wherein the ratio of the height of the end walls to the width of the bottom wall slot is approximately 3.5.

19. The hood of claim 17 wherein:

a. the width of the bottom wall slot is approximately two inches;

b. the height of the end walls is approximately seven inches; and c. the distance between the end walls is between approximately nine and 18 inches.

20. A hood useful for collecting overspray of a sprayed coating material comprising:

a. opposed end walls of a predetermined height;

b. a top wall connected to the end walls and perpendicular thereto;

c. a bottom wall connected to the end walls and perpendicular thereto and defining a slot of a predetermined width extending between the end walls, the end, bottom, and top walls defining a throat, wherein the bottom wall is comprised of a pair of coplanar panels and a pair of angled strips joined to the respective panels and converging toward the top wall, the angled strips having respective free edges that are spaced apart a predetermined distance to define the bottom wall slot; and d. an outside wall connected to the top, end, and bottom walls and perpendicular thereto and opposite the throat, the end, top, bottom, and outside walls cooperating to define a chamber, so that overspray can enter the chamber through the slot in the bottom wall and leave through the throat.

21. A hood useful for collecting overspray of a sprayed coating material comprising:

a. opposed end walls of a predetermined height;

b. a top wall connected to the end walls and perpendicular thereto;

c. a bottom wall connected to the end walls and perpendicular thereto and defining a slot of a predetermined width extending between the end walls, the end, bottom, and top walls defining a throat; and d. an outside wall connected to the top, end, and bottom walls and perpendicular thereto and opposite the throat, the end, top, bottom, and outside walls cooperating to define a chamber, wherein the outside wall defines an opening therethrough; and the hood further comprises a face plate removably fastened to selective ones of the top, end, and bottom walls to thereby provide access to the hood chamber, so that overspray can enter the chamber through the slot in the bottom wall and leave through the throat.

22. A hood useful for collecting overspray of a sprayed coating material comprising:

a. opposed end walls of a predetermined height;

b. a top wall connected to the end walls and perpendicular thereto;

c. a bottom wall connected to the end walls and perpendicular thereto and defining a slot of a predetermined width extending between the end walls, the end, bottom, and top walls defining a throat, wherein the outside walls is formed with a plate that makes an obtuse angle therewith and that has a free edge spaced a short distance from the top wall, so that overspray can enter the chamber through the slot in the bottom wall and leave through the throat, and the plate free edge and the top wall cooperate to define a slit that enables atmospheric air to enter the hood chamber.

23. A hood useful for collecting overspray of a sprayed coating material comprising:

a. opposed end walls of a predetermined height;

b. a top wall connected to the end walls and perpendicular thereto;

c. a bottom wall connected to the end walls and perpendicular thereto and defining a slot of a predetermined width extending between the end walls, the end, bottom, and top walls defining a throat, wherein the top wall is formed with a tab that makes an obtuse angle therewith and that extends between the end walls at the throat of the hood; and d. an outside wall connected to the top, end, and bottom walls and perpendicular thereto and opposite the throat, the end, top, bottom, and outside walls cooperating to define a chamber, so that overspray can enter the chamber through the slot in the bottom wall and leave through the throat.

* * * * *